United States Patent [19]

Keller et al.

[11] Patent Number: 4,846,025

[45] Date of Patent: Jul. 11, 1989

[54] RADIATOR CAP TOOL

[76] Inventors: Jimmy L. Keller, Rte. 1, Box 88; Lloyd R. Stark, Rte. 1, Box 9, both of Sawyer, Kans. 67134

[21] Appl. No.: 255,950

[22] Filed: Oct. 11, 1988

[51] Int. Cl.[4] ..... B67B 7/44

[52] U.S. Cl. ..... 81/3.09; 81/3.4; 81/176.1

[58] Field of Search ..... 81/3.07, 3.09, 3.08, 81/3.4, 125, 176.1

[56] References Cited

U.S. PATENT DOCUMENTS

| | | | |
|---|---|---|---|
| 2,895,363 | 7/1959 | Cox | 81/125 |
| 3,007,357 | 11/1961 | Nalley | 81/176.1 |
| 3,048,067 | 8/1962 | Miles et al. | 81/176.1 |
| 3,121,355 | 2/1964 | Morel et al. | 81/3.4 |
| 3,186,263 | 6/1965 | Grote | 81/176.1 |
| 3,253,485 | 5/1966 | Grote | 81/176.1 |
| 3,481,227 | 12/1967 | Shook | 81/176.1 |
| 4,512,215 | 4/1985 | Krauchick | 81/176.1 |
| 4,697,480 | 10/1987 | Robideau | 81/3.09 |

*Primary Examiner*—Roscoe V. Parker
*Attorney, Agent, or Firm*—John W. Carpenter

[57] ABSTRACT

A tool for removing radiator caps. The tool has a hollow handle and a flanged hollow face. The hollow face has a recess with a perimeter. The perimeter has a pair of opposed rectangular indentations, at least one pair of opposed arcuate indentations, and a pair of tapering indentations which interrupt the perimeter to form a pair of opposed openings.

8 Claims, 2 Drawing Sheets

FIG. 1
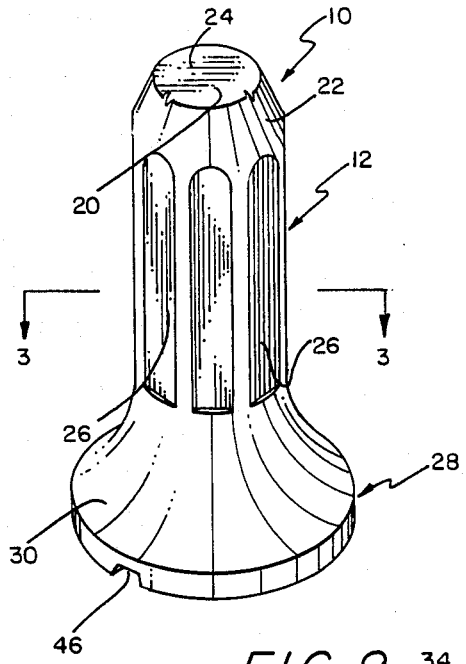
FIG. 2
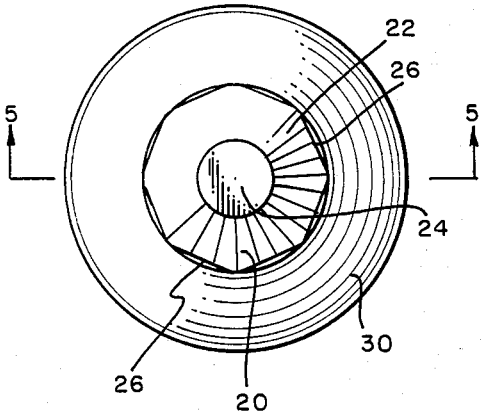
FIG. 9
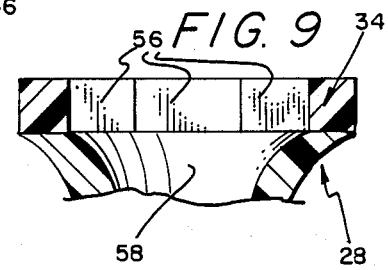
FIG. 4
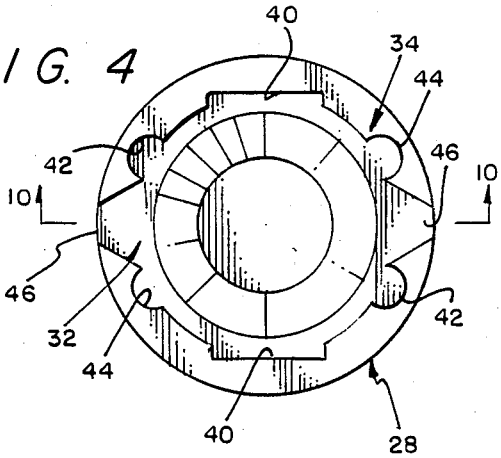
FIG. 3
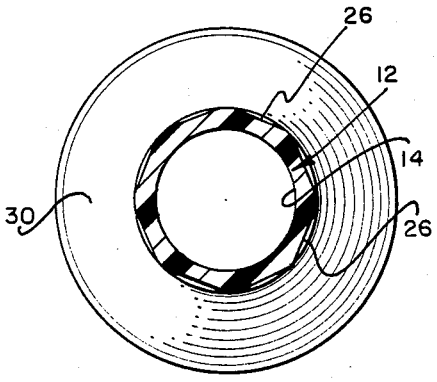
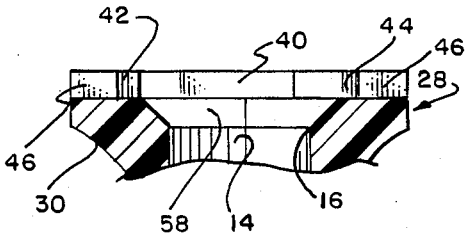
FIG. 10

RADIATOR CAP TOOL

BACKGROUND OF THE INVENTION

1. Field of the Invention

This invention pertains to a tool for safely releasing, removing, and replacing the cap of an automobile radiator and the like.

2. Description of the Prior Art

A patentability investigation was conducted and the following U.S. Pat. Nos. were discovered: 2,895,363 to Cox; 3,007,357 to Nalley; 3,048,067 to Miles et al.; 3,186,263 to Grote; 3,253,485 to Grote; 3,481,227 to Shook; and 4,512,215 to Krauchick. None of the foregoing U.S. patents teach or suggest the particular radiator cap tool of this invention.

SUMMARY OF THE INVENTION

The present invention accomplishes its desired objects by providing a tool for removing radiator caps. The tool broadly comprises a generally hollow cylindrical handle means terminating at a first end in a handle cap means integrally formed therewith to seal-off the first end. The handle means also terminates at a second end in a tapering outwardly flanged hollow face means formed integrally therewith for receiving therein a radiator cap. The hollow face means has a structure defining a recess having a perimeter. The radiator cap removably lodges within the recess in order to be turned when the perimeter is forced against the radiator. The perimeter has a pair of opposed rectangular indentations, at least one pair of opposed arcuate indentations, and a pair of tapering indentations which interrupt the perimeter to form a pair of opposed openings.

It is therefore an object of the present invention to provide a tool for removing radiator caps.

This, together with the various ancillary objects and features which will become apparent to those skilled in the art as the following description proceeds, are attained by this novel tool, a preferred embodiment being shown with reference to the accompanying drawings, by way of example only, wherein:

BRIEF DESCRIPTION OF THE DRAWINGS

FIG. 1 is a perspective view of the tool of this invention;

FIG. 2 is a top plan view of the tool of FIG. 1;

FIG. 3 is a horizontal sectional view taken in direction of the arrows and along the plane of line 3—3 in FIG. 1;

FIG. 4 is a bottom plan view of the tool of FIG. 1;

FIG. 9 is a partial vertical sectional view taken in direction of the arrows and along the plane of line 9—9 in FIG. 8; and FIG. 10 is a partial vertical sectional view taken in direction of the arrows and along the plane of line 10—10 in FIG. 4.

DETAILED DESCRIPTION OF THE INVENTION

Figure 5:
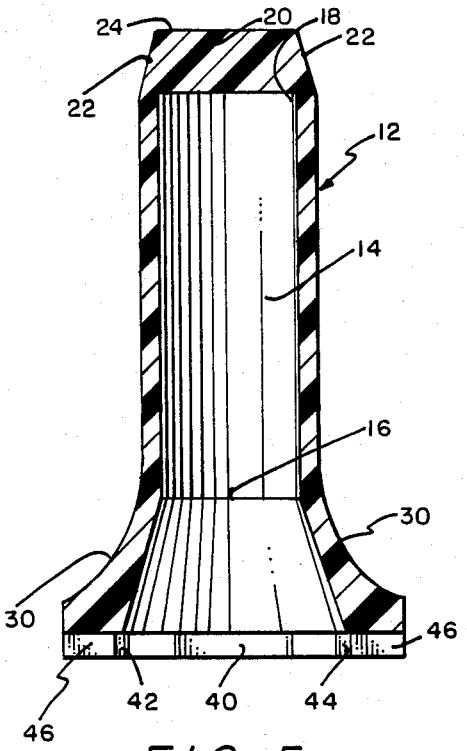
FIG. 5 is a vertical sectional view taken in direction of the arrows and along the plane of line 5—5 in FIG. 2.

Referring in detail now to the drawings wherein similar parts of the invention are identified by like reference numerals, there is seen the tool of this invention, generally illustrated as 10, possessing a hollow cylindrical handle, generally illustrated as 12. The handle 12 has a circular, cylindrical inner wall 14 terminating in circular openings 16 and 18. Opening 18 is capped with a handle cap 20 which has a tapering surface 22 terminating in a cap end 24. The handle 12 also has an outside structure possessing a plurality of longitudinal channels 26.

Figure 7:
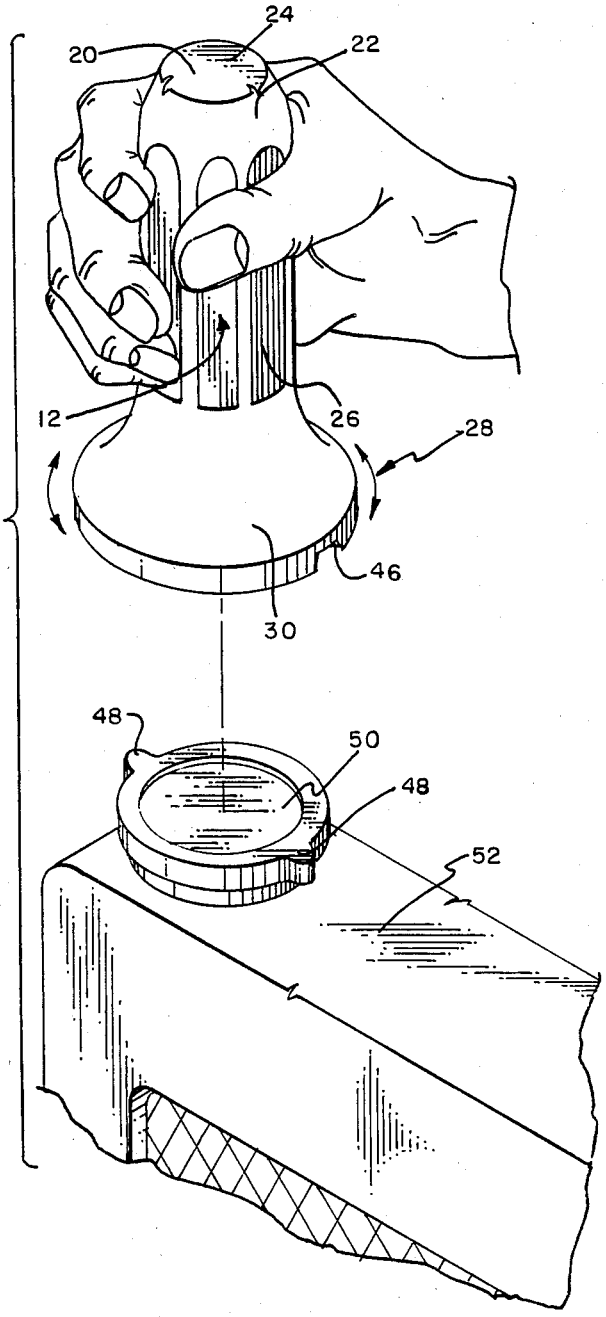
FIG. 7 is an exploded segmented perspective view of the tool being aligned to engage a radiator cap.

The tool 10 also has a flanged hollow face means, generally illustrated as 28, that is formed integrally with the handle 12. The face means 28 has a surface 30 that tapers or flanges outwardly as best illustrated in FIGS. 1, 5, and 7. The hollow face means 28 has a recess, generally illustrated as 32, having a perimeter, generally illustrated as 34.

The recess 32 and the perimeter 34 have two preferred embodiments. In the preferred embodiment of FIGS. 1, 2, 3, 4, 5, and 10, the recess 32 is formed with a perimeter 34 that is discontinuous as best shown in FIG. 4. More specifically, the perimeter 34 has a pair of opposed rectangular indentations 40—40, a first pair of opposed arcuate (preferably semi-circular) indentations 42—42, and a second pair of opposed arcuate (also preferably semi-circular) indentations 44—44. The perimeter 34 is discontinuing or interrupted in the sense of having a pair of opposed tapering indentations 46—46 which extend through the entire width or structure of the perimeter 34. The tapering indentations 46—46 are for receiving a pair of ears 48—48 of a radiator cap 50 rotatably mounted to a radiator 52.

Figure 8:
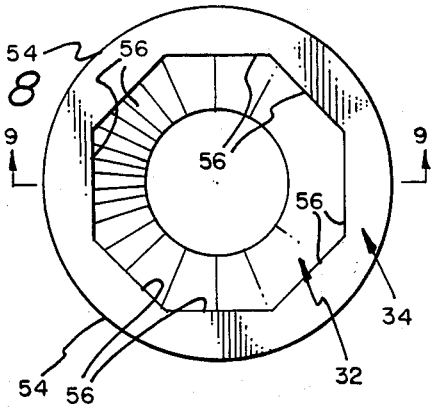
FIG. 8 is a bottom plan view of another embodiment of the tool.

In the preferred embodiment of FIGS. 8 and 9, the recess 32 and the perimeter 34 are formed such that the perimeter 34 is continuous and is not interrupted or discontinuous by any tapering indentations 46—46. More specifically, the perimeter 34 is formed such as to be continuously circular on the outside 54 thereof, and octagonal on the inside thereof with eight interconnected walls, each represented as 56. The preferred embodiment of FIGS. 8 and 9, and the preferred embodiment of FIGS. 1-5 and 10, each include a floor 58 that tapers downwardly and inwardly to terminate at the opening 18 of the inner wall 14 of the handle 12.

Figure 6:
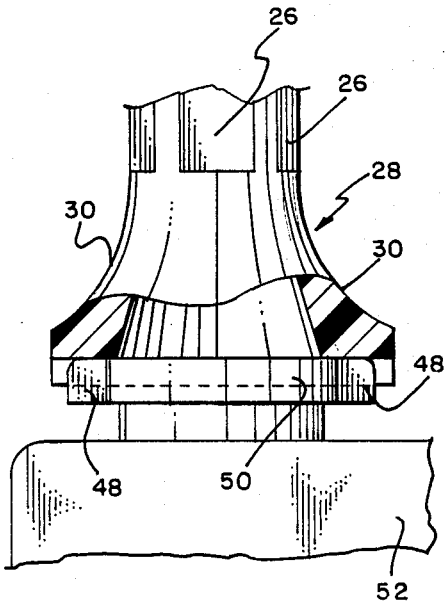
FIG. 6 is a partial sectional view illustrating the tool engaged to the radiator cap.

With continued reference to the drawings for operation of the invention, a person desiring to remove a radiator cap will grasp the tool 10 as illustrated in FIG. 7. The longitudinal channels 26 provide a means for a steadfast grasp. The tool 10 should be aligned with the radiator cap 50 such that the ears 48—48 will slidably pass into the tapering indentations 46—46, as best illustrated in FIG. 6. After the tool 10 has been disposed as such, the user merely turns the tool 10 such that the perimeter 34 of the tool is forced against the sides of the radiator cap 50. Such forceful exertion will loosen the radiator cap and allow pressurized steam or the like to vent from the radiator 52. It is well known that whenever a liquid cooled internal combustion engine operates under conditions leading to heating of the cooling liquid, it is possible for the liquid to reach its vaporizing temperature or even to be heated above the boiling point. It is also well known that in some cases the vapor builds up pressure sufficiently to eject a substantial quantity of liquid from the radiator if the radiator cap is removed before the pressure is vented. Even if the radiator cap is only loosened so that vapor may escape relatively slowly from the radiator, the vapor itself may well be above the boiling point of the liquid. In either case, the person releasing or removing the cap is in danger of being scalded or otherwise hurt in attempting to avoid ejected hot liquid or a cloud of hot vapor. The tool 10 of this invention will protect the person from being scalded or otherwise hurt from hot liquid or hot vapor. The hollow face 28 of the tool 10 has its perimeter 34 formed such as to engage any radiator cap that is presently being built. More specifically, the recess 32 and perimeter 34 of the embodiment of the invention in FIG. 4, along with the recess 32 and perimeter 34 of the embodiment of the invention in FIG. 8, are formed such as to fit over the majority of radiator caps 50 that are presently being built. Such caps 50 merely seat into the recess 32 and, depending on the configuration of the particular radiator cap, tapering indentations 46—46, opposed arcuate indentations 42—42 or 44—44, or rectangular indentations 40—40, or the octagonal walls 56 for the embodiment of FIG. 8, have been included or formed within the perimeter 34 such that any particular radiator cap 50 can be turned with the tool 10 of this invention.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. A tool for removing radiator caps comprising a generally hollow cylindrical handle means terminating at a first end in a handle cap means integrally formed therewith to seal-off said first end and terminating at a second end in a tapering outwardly flanged hollow face means formed integrally therewith for receiving therein a radiator cap, said hollow face means having a structure defining a recess having a perimeter and said radiator cap removably lodges within said recess to be turned when the perimeter is forced against the radiator, said perimeter having a pair of opposed rectangular indentations, at least one pair of opposed arcuate indentations, and a pair of tapering indentations which interrupt the perimeter to form a pair of opposed openings.

2. The tool of claim 1 wherein said perimeter comprises two pairs of opposed arcuate indentations.

3. The tool of claim 2 wherein said flanged hollow face additionally comprises a tapering downwardly and inwardly floor terminating on the inside of said hollow handle means.

4. The tool of claim 3 wherein said handle means has a structure defining a plurality of longitudinal channels.

5. The tool of claim 4 wherein said handle cap has a tapering surface terminating at an end thereof.

6. A tool for removing radiator caps comprising a generally hollow cylindrical handle means terminating at a first end in a handle cap means integrally formed therewith to seal-off said first end and terminating at a second end in a tapering outwardly flanged hollow face means formed integrally therewith for receiving therein a radiator cap, said hollow face means having a structure defining a recess having a perimeter and said radiator cap removably lodges within said recess to be turned when the perimeter is forced against the radiator, said perimeter being generally circular on the outside and octagonal on the inside to possess eight walls, and said flanged hollow face additionally comprises a tapering downwardly and inwardly floor terminating on the inside of said hollow handle means.

7. The tool of claim 6 wherein said handle means has a structure defining a plurality of longitudinal channels.

8. The tool of claim 7 wherein said handle cap has a tapering surface terminating at an end thereof.

* * * * *